US005288131A

United States Patent [19]

Singley

[11] Patent Number: 5,288,131

[45] Date of Patent: Feb. 22, 1994

[54] WOODEN CHAIR BOTTOM

[76] Inventor: Jeremy Singley, P.O. Box 236, East Middlebury, Vt. 05740

[21] Appl. No.: 670,023

[22] Filed: Mar. 15, 1991

[51] Int. Cl.[5] ..... A47C 7/16

[52] U.S. Cl. ..... 297/452.24; 297/452.21

[58] Field of Search ..... 297/459, 452, 195

[56] References Cited

U.S. PATENT DOCUMENTS

| | | | |
|---|---|---|---|
| D. 150,683 | 3/1947 | Eames . | |
| 486,479 | 11/1892 | Lancaster . | |
| 1,026,395 | 5/1912 | Herzog . | |
| 1,140,964 | 5/1915 | Dittmar . | |
| 2,386,821 | 10/1945 | Tardiff | 144/309 |
| 2,905,579 | 9/1959 | Sumner | 154/116 |
| 3,230,013 | 1/1966 | Morrison | 297/452 |
| 4,897,140 | 1/1990 | Opsvik | 144/354 |

OTHER PUBLICATIONS

Tage Frid, Three Legged Stool, *Fine Woodworking* V2 #1 1977 p. 36.

Roy Sieber, *African Furniture,* 1980, pp. 148-149.

*Primary Examiner*—Peter R. Brown

*Assistant Examiner*—Milton Nelson, Jr.

[57] ABSTRACT

An improved trough-shaped chair bottom made from a plurality of wood members glued together in such a way that, among the members comprising either half of the chair bottom, there are no abrupt changes in the direction of the woodgrain between any member and its neighbor, offering a number of advantages over both solid wood chair bottoms made from flat blanks and trough-shaped chair bottoms made from cross-ply layers of veneer. The members composing the improved chair bottom may include, but are not exclusive to, bevel-edged longitudinal staves; staggered, square-edged longitudinal staves; and parallel layers of bent wood or veneer.

2 Claims, 4 Drawing Sheets

WOODEN CHAIR BOTTOM

BACKGROUND—FIELD OF INVENTION

This invention relates to the construction of wooden chair bottoms with a curved transverse cross-section.

BACKGROUND—DISCUSSION OF PRIOR ART

Heretofore, wooden chair bottoms have typically been made in one of two ways. The original method, developed over two centuries ago, involves edge-glueing strips of wood together to form a flat plank of appropriate width, called a blank. A depression is scooped in the blank's top surface to support the sitter's buttocks. This depression usually includes a longitudinal ridge—or "pommel"—stretching from the center of the chair bottom's top front edge to about the chair bottom's midpoint, to support the sitter's thighs. Often the edges of such a chair bottom are chamfered and saddled (rounded from below and above, respectively) to give the finished chair bottom a pleasing appearance and reduce its weight.

A more recent method involves molding cross-grained layers of veneer into a tapered trough shape. U.S. Design Patent No. 150,683 to Charles Eames (1948) shows an example of a chair bottom made in this way.

In the January, 1985 issue of Fine Woodworking Magazine I described my invention of a new method of producing a trough-shaped sea bottom of solid wood. That method involved bending a flat, edge-glued blank into a trough shape by sawing diagonal kerfs into the blank's bottom and gluing wedges into the kerfs. To create a pommel I used a variation on this technique whereby two flat, edge-glued half blanks were kerf-bent and subsequently joined to each other at a bias.

All of the above methods suffer from one or more disadvantages:

(a) A chair bottom made by scooping a depression in a flat, edge-glued blank is too shallow for comfort because the depth of the depression is limited to less than the thickness of the stock.

(b) Saddling a chair bottom made from cross-grained layers of veneer would be unsightly due to exposure of the cross-grained layers.

(c) Both prior methods produce chair bottoms that are relatively thin at the points where the chair's legs are normally attached. Thus the legs must be reinforced with unsightly rungs or braces.

(d) If turned legs ar tenoned into holes bored in a cross-ply chair bottom, the wood of the seat will not shrink in the same direction as the wood of the legs, creating a risk that the legs will eventually loosen.

(e) A kerf-bent chair bottom, while of sufficient thickness for unbraced legs, is time-consuming to produce.

(f) The kerfs in a kerf-bent chair bottom intersect the chair bottom's wood grain diagonally, which eventually causes unsightly kinks in the chair bottom's top surface due to uneven shrinkage.

OBJECTS AND ADVANTAGES

Accordingly, several objects and advantages of the present invention are:

(a) To provide an efficient means of producing deeply-dished chair bottoms, with or without a pommel, that can be chamfered and/or saddled attractively;

(b) To provide an inexpensive and practical means of producing a comfortable chair bottom with uniform grain direction and of sufficient over-all thickness for the attachment of unreinforced parts.

DRAWING FIGURES

In the drawings, closely related figures have the same number but different alphabetic suffixes.

Figure 1A:
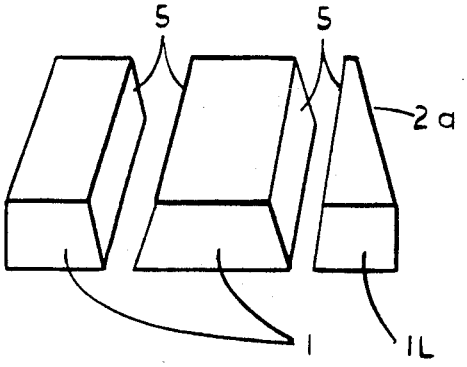
FIGS. 1A and 1B show wood staves ready to be edge-glued into a pair of composed chair bottom half blanks.
Figure 1B:
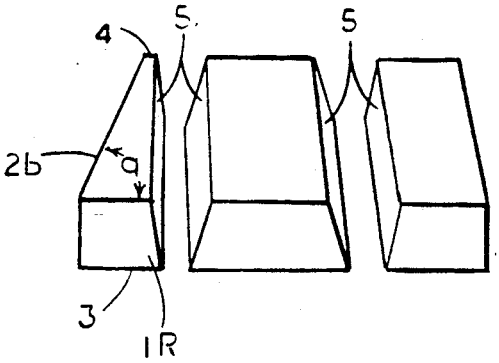

REFERENCE NUMERALS IN DRAWINGS a: angle of taper

A: the point on the right half blank where the outline of the seat intersects the chair bottom's centerline B: a point three inches in front of point A on the centerline A': the point on the left half blank where the outline of the seat intersects the chair bottom's centerline B': a point three inches in front of point A' on the centerline

1 stave

1C stave with tongues and grooves

1E overlength staves

1L left hand tapered stave

1R right hand tapered stave

**2*a*** right hand tapered edge of left hand tapered stave

**2*b*** left hand tapered edge of right hand tapered stave

3 front (wide) edge of tapered stave

4 rear (narrow) edge of tapered stave

5 slanted edge of stave

**6*a*** jointed edge of left half blank

**6*b*** jointed edge of right half blank

7A cross section of chair bottom taken near midpoint 7B cross section of chair bottom taken near front
8 outline of seat to be cut from blank
9 arc indicating curvature of blank's top surface 3" in front of point A
10 the radius of arc 9
10C the center of arc 9
11L left hand half blank
11R right hand half blank
14 dowel
14*a* glued dowel end
14*b* 1 cm (three-eighths inch) gap
15 layers of bent veneer
16 arrows indicating direction of grain
17L left hand half blank
17R right hand half blank
18 center stave with two tapered edges
19 lines indicating final contour of milled blank
20 square-edge strips
21 longitudinal axis of trough (does not necessarily match grain direction)
30 over-long, over-wide trough shape milled of wood
31 transverse cross-cut line
32 longitudinal rip line
33 tongues
34 grooves
35 milled top surface
36 milled bottom surface

DESCRIPTION OF INVENTION—FIGS. 1-11

Figure 7:
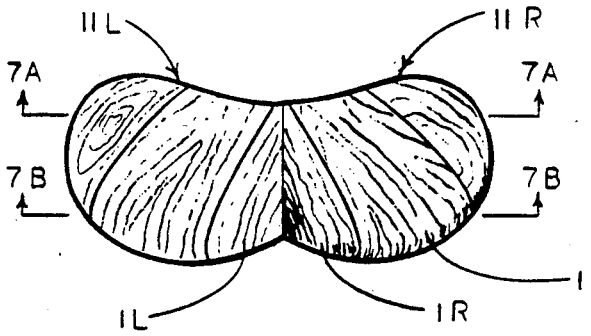
FIG. 7 shows a finished chair bottom made from a blank like that shown in FIG. 3, after chamfering and saddling.
Figure 7A:
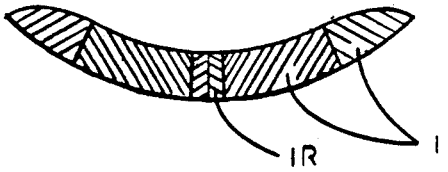
FIG. 7A shows a transverse cross section of FIG. 7, taken near the chair bottom's center.

The present invention is a wooden, trough-shaped chair bottom in which the grain direction in either half of the chair bottom is substantially uniform. A typical embodiment of the invention is shown in FIG. 7 . The shape of the chair bottom is a bifurcated trough, with an oblate "U" shaped rear cross section 7A and an oblate "W" shaped front cross section 7B. The chair bottom is made from blanks, FIGS. 2A and 2B, consisting of a plurality of beveled-edged wood staves 1 which have first been edge-glued into a pair of arcuated half blanks, 11R and 11L, one of said half blanks 11L having a tapered longitudinal edge 6*a* on its right side, and the other 11R having a tapered longitudinal edge 6*b* on its left side, so that the composed half blanks may subsequently be glued together at a bias, FIG. 3.

Additional embodiments are shown in FIGS. 4-6 and 8-11. There are various possibilities with regard to the width of the staves 1 comprising the chair bottom. Said staves may be of random width, FIG. 2A, or all of equal width, FIG. 11. Each stave may be of uniform width from end to end or any number of staves may be tapered in length—that is, wider at one end than at the other—to suit the design of the finished chair bottom. As an aesthetic variation, adjacent staves may alternate in width from wide to narrow, and in species of wood from light to dark, to create a visual herringbone pattern when the two half blanks are mated.

Figure 4:
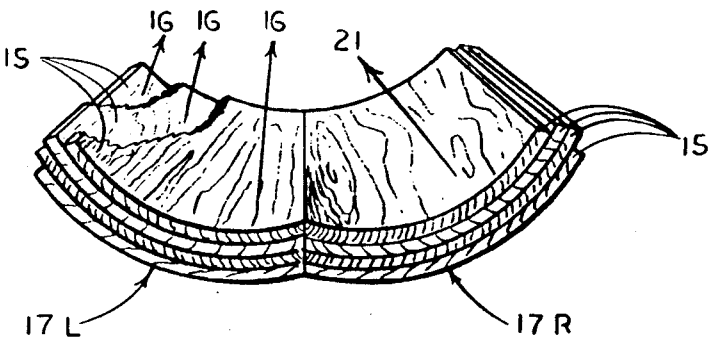
FIG. 4 shows a chair bottom blank made from layers of bent veneer.

The chair bottom blank in FIG. 4 is made from layers of molded veneer. In each half of the chair bottom 17L and 17R the grain of the veneer may run in any direction, as long as the grain of every layer is substantially parallel 16 with every other layer in said half. Similarly, half blanks may be made from one or more layers of wood from 2 cm to 35 cm (0.25 inch to 1.5 inches) thick, steam-bent into a trough shape.

Figure 5:
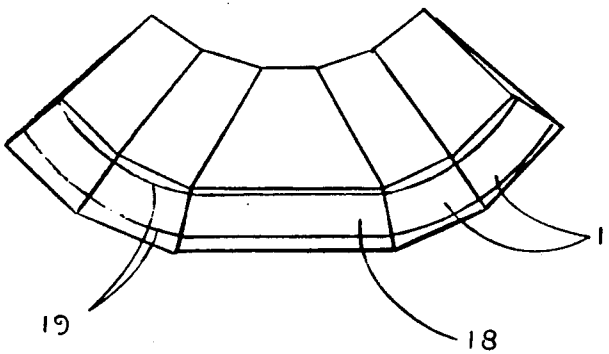
FIG. 5 shows a chair bottom blank with a single tapered center stave to eliminate assembly steps.

In FIG. 5 the staves composing the chair bottom blank include a center stave 18 which is longitudinally tapered on both sides, so that the entire chair bottom may be glued up in one operation, rather than as two halves. In this form a short pommel, if one is desired, may be carved into the chair bottom's front edge, but it must necessarily be less substantial than that shown in FIG. 7B unless the center stave 18 is cut from over-thick stock.

Figure 3:
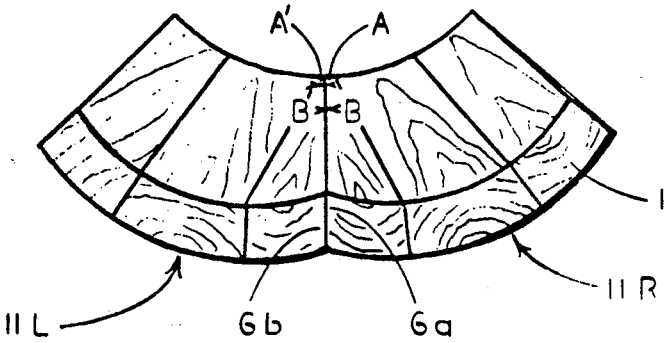
FIG. 3 shows the half blanks of FIGS. 2A and 2B after both have been milled, edge jointed and glued edge to edge into a single chair bottom blank.
Figure 6:
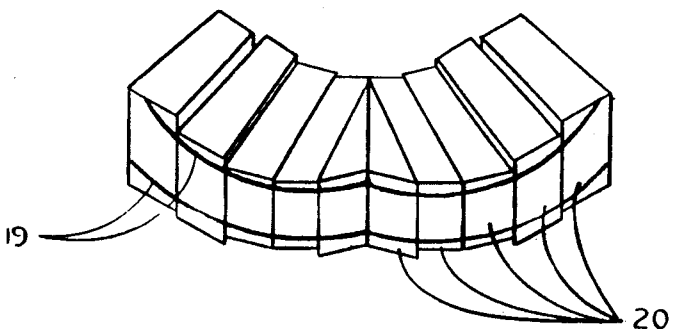
FIG. 6 shows a chair bottom blank made from staggered, square-edged longitudinal strips.

The chair bottom blank in FIG. 6 is made in the same way as that shown in FIG. 3, except that the staves 20 are square-edged and staggered. By turning the stock's thickness edgewise, this method allows considerable thickness for subsequent shaping or milling operations, if desired.

Figure 9:
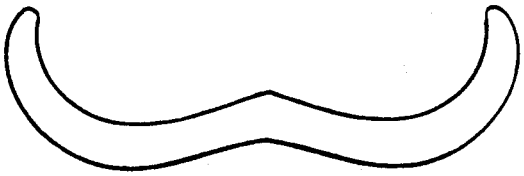
FIG. 9 shows the cross-sectional outline of a chair bottom with irregular radii and varying thickness.

FIG. 9 shows a chair bottom made from half blanks with a volute cross section and a non-uniform thickness, to demonstrate how the invention need not be limited to only circular arcs or to stock of uniform thickness.

Figure 10:
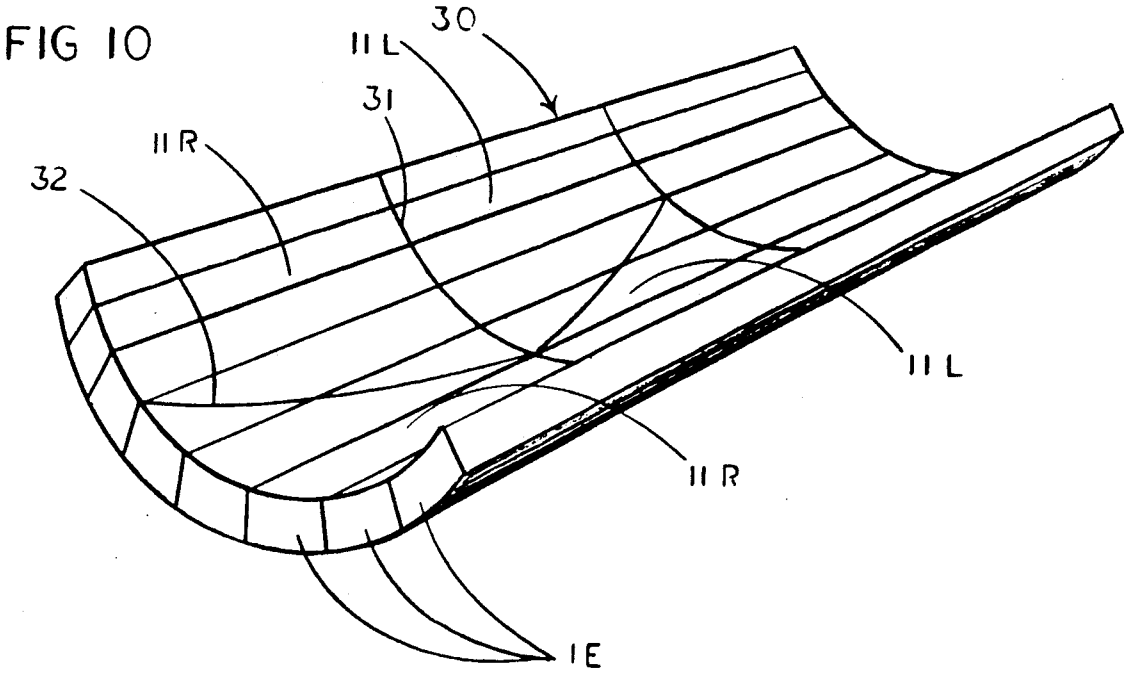
FIG. 10 shows an over-wide, over-long trough shape from which multiple chair bottom half blanks may be cut.

FIG. 10 shows how multiple half blanks 11R and 11L may be sawn from an over-wide, over-long trough shape 30, economizing on labor.

Figure 11:
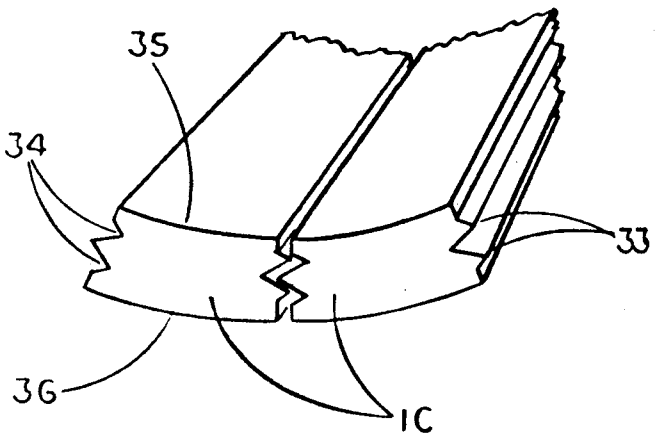
FIG. 11 shows staves with matching tongues and grooves.

FIG. 11 shows how the stave joints 5 and/or the center joints 6*a* and 6*b* may be provided with substantially undulating opposite tongues 33 and grooves 34, respective. In addition to or in place of the provision of tongues and grooves, said joints may be reinforced with splines, dowels, biscuits or similar means.

Figure 7B:
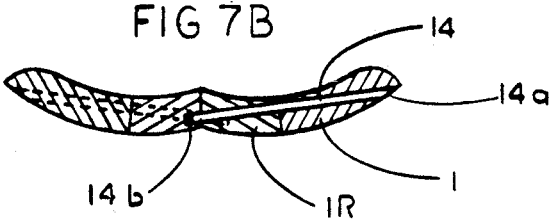
FIG. 7B shows a transverse cross section of FIG. 7, taken near the chair bottom's front.

Regardless of whether or not the individual joints are so reinforced, the composed chair bottom blank may be reinforced with overlapping, edge-to-edge dowels 14, as shown in FIG. 7B. The dowels are glued at one end only 14*a*, and there must be a 1 cm (three-eights inch) gap 14*b* between the dowels' interior ends and the hole bottoms to allow for shrinkage.

FIG. 11 also shows how each stave 1 may be prepared so as to bring forth corresponding transversely curved top and bottom longitudinal surfaces 35 and 36, respective, before the staves are assembled into a composed chair bottom blank or half blank, in order to reduce the amount of stock which must be removed after the staves are glued together.

Several combinations of the above techniques may be used to obtain a similar shaped chair bottom.

Figure 8:
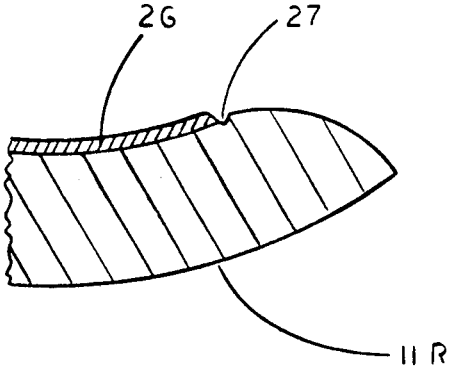
FIG. 8 shows a cross section of a chair bottom's right edge, showing how a layer of veneer may be added to the chair bottom's top surface. The edge of the veneer is delineated with a scribed line.

The chair bottom detailed in FIG. 8 is made using any of the above techniques, with the addition of a layer of veneer 26 glued onto its top surface. The direction of the veneer's woodgrain is parallel to that of the seat bottom to which it is affixed. Where the chair bottom is saddled, the edge of the veneer may be delineated with a scribed line 27, or with purfling (an inlaid strip).

MANUFACTURE OF THE INVENTION—FIGS. 1-3 and FIGS. 7-7B

FIGS. 1A, 1B, 2A, 2B, and 3 show a method of manufacturing a chair bottom like that shown in FIG. 7. The chair bottom is sawn from a blank shaped like a bifurcated trough, FIG. 3, made up of two arcuated wooden half blanks, 11L and 11R, mated at a bias.

A first step includes the provision of a plurality of substantially straight wood staves 1 for the manufacture of each half blank. The length of each stave will depend on the desired outline of the finished chair bottom. The number, thickness and width of the staves will be adapted to make up a composed rough arc of pre-determined inside and outside radii. A typical inside radius might be 33 cm (13 inches). The thickness of each stave will be substantially greater than that of the finished chair bottom, to allow for subsequent removal of material when the glued-up composed rough arc is milled to yield transversely curved top and bottom surfaces of said pre-determined radii. Finished seats are typically from 2 cm (three-fourths inch) to 5 cm (two inches) in thickness. Staves are typically from 5 cm (two inches) to 20 cm (eight inches) wide.

One of the staves 1R or 1L provided for each half blank will taper lengthways, so that its front edge 3 is substantially wider than its rear edge 4. A typical taper would be from 13 cm (5 inches) across the front edge to 2 cm (0.75 inches) across the rear edge of the stave, with a 76° angle of taper a.

Simultaneously with the provision of the staves, or in appropriate association therewith, the longitudinal side edges of each stave are prepared so as to provide oppositely slanting edge portions 5 on either side edge, said slanting edge portions when extended along an imaginary line meeting at the origin 10C of the composed arc being manufactured.

Figure 2A:
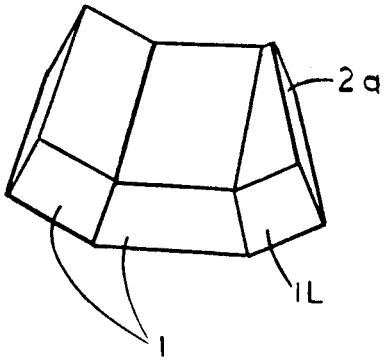
FIG. 2A shows the same staves of FIG. 1A after edge-gluing into a composed rough left half blank.
Figure 2B:
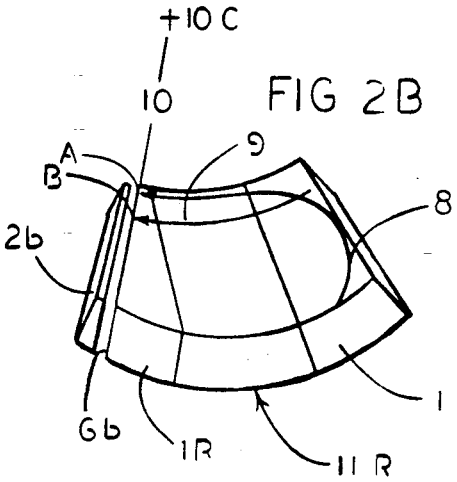
FIG. 2B shows the staves of FIG. 1B after edge-gluing and milling.

Having been provided with said side edges, the staves will be arranged in sets of an appropriate number and order so as to make up a pair of composed half blanks, FIG. 2A and FIG. 2B, said pair to be comprised of one left-hand half blank FIG. 2A, and one right-hand half blank FIG. 2B. The set of staves composing the right-hand half blank will include as the outermost left-hand stave one of the aforementioned lengthways tapered staves 1R, with the wide end 3 of the tapered stave oriented toward the half blank's front edge. The set of staves composing the left-hand half blank will include as the outermost right-hand stave another of the aforementioned lengthways tapered staves 1L, again with the wide end to the front.

Having been arranged in sets, the side edges of each stave will be coated with an adhesive, whereafter said side edges will be brought in side-wise engagement with the corresponding side edges of an adjacent stave, so as to form a faceted arc, FIG. 2A.

After the adhesive has cured, the top and bottom surfaces of the composed half blanks are processed by conventional wood processing equipment, for example equipment for milling or grinding, to remove excess stock until corresponding transversely curved longitudinal top and bottom contours are attained, FIG. 2B. (FIG. 2B shows the right-hand half blank after milling while FIG. 2A shows the left-hand half blank before milling.)

After the half blanks have been milled smooth, the left-hand longitudinal edge **2*b* of the right half blank 11R, and the right-hand longitudinal edge 2*a* of the left half blank 11L** will each be provided with a tapered edge joint as follows:

First a point A is marked on the surface of each half blank indicating where the finished chair bottom's outline 8 will intersect the edge to be jointed **6*b***.

The next step is to mark a point B on the edge to be jointed 3 inches in front of point A on both half blanks.

The next step is to lay out a line 9 on the half blank's transverse axis and intersecting point B.

After the line 9 has been laid out on each half blank, the edges **2*a* and 2*b* will each be provide with a vertically slanting edge portion 6*a* and 6*b*, said slanting edge portion when extended along an imaginary line 10 through point B passing through the origin 10C of the arc 9. FIG. 2B shows said slanting edge portion 6*a* being created on the left edge of the right half blank by removal of a thin slice of waste stock 2*b*. After milling, the same operation would be carried out on the right edge 2*a* of the left half blank shown in FIG. 2A**.

When the half blanks have been provided with slanting edges **6*a* and 6*b***, said edges will be coated with an adhesive and brought into side-wise engagement each with the other so that point A of the right-hand half blank meets the corresponding point A′ of the left-hand half blank and likewise point B meets corresponding point B′.

After the adhesive has cured the chair bottom's outline will be traced onto the top surface of the finished seat blank shown in FIG. 3, after which said outline will be cut out with a bandsaw or similar appliance. The seat bottom may then be saddled and/or chamfered, FIG. 7, to give it a pleasing appearance.

SUMMARY, RAMIFICATIONS AND SCOPE

Accordingly, the reader will see that the solid wood trough-shaped chair bottom of this invention can be manufactured with the same stock, the same equipment, and in about the same time as a conventional flat chair bottom made of solid wood, while offering considerably more comfort and aesthetic appeal. Furthermore, the solid wood trough-shaped chair bottom has the following advantages:

Unlike flat seats or trough-shaped plywood seats, it is a practical method of producing chair bottoms thick enough to support unreinforced chair legs, requiring no braces or rungs. In addition, its extra thickness allows room for edge-to-edge doweling to prevent splitting.

Because the grain direction is substantially uniform, differential shrinkage between the chair bottom and parts that have been tenoned into it is reduced.

Unlike plywood bottoms, the solid wood bottom may be chamfered and saddled attractively.

The invention of an easily manufactured curvilinear chair bottom introduces the possibility of whole new chair designs heretofore impractical, including chairs with flowing shapes and sculpted edges.

Although the description above contains many specificities, these should not be construed as limiting the scope of the invention but merely providing illustrations of some of the presently preferred embodiments of this invention. For example, a solid wood trough-shaped chair bottom might be carved from a blank shaped like a shallow "V," made up of two flat half-blanks joined at an obtuse angle. Also the direction of the grain can vary widely—from parallel to perpendicular to the chair bottom's centerline and anywhere in between—according to the method used to make up the rough arcs and the orientation of the half blanks.

Thus the scope of the invention should be determined by the appended claims and their legal equivalents, rather than by the examples given.

I claim:

1. A unitary wooden chair bottom comprised of at least one bevel-edged, longitudinally extending strip and at least one tapered longitudinally extending strip, each having top, bottom, front, rear and side edges and each said beveled-edged strip having at least one sloping longitudinal side edge forming an obtuse angle with the top surface of the beveled-edged strip and each said tapered strip being wider at its front edge than at its rear edge, said beveled strip and said tapered strip being glued together along their longitudinal side edges and disposed in symmetric alignment with the front-to-back centerline of the chair bottom and forming therein a divergent side-to-side trough shape.

2. The chair bottom of claim 1 wherein two of said edge-glued tapered strips form a center portion of the chair bottom and each of which tapered strips is beveled on the longitudinal side edge of the strip adjacent the front-to-back center line of the chair bottom such that said bevel forms an acute angle with the top surface of the tapered strip forming a pommel bifurcating said trough shape.

* * * * *